US005799619A

United States Patent [19]

Hoshino et al.

[11] Patent Number: 5,799,619

[45] Date of Patent: Sep. 1, 1998

[54] VISCOUS FLUID HEATER

[75] Inventors: Tatsuyuki Hoshino; Takashi Ban; Takahiro Moroi; Kiyoshi Yagi, all of Kariya, Japan

[73] Assignee: Kabushiki Kaisha Toyoda Jidoshokki Seisakusho, Kariya, Japan

[21] Appl. No.: 870,254

[22] Filed: Jun. 6, 1997

[30] Foreign Application Priority Data

Jun. 7, 1996 [JP] Japan ..... 8-145771
Jun. 18, 1996 [JP] Japan ..... 8-157167

[51] Int. Cl.[6] ..... F22B 3/06; F02N 17/04

[52] U.S. Cl. ..... 122/26; 126/247

[58] Field of Search ..... 123/142.5 R; 122/26; 126/247

[56] References Cited

U.S. PATENT DOCUMENTS 4,312,322 1/1982 Freihage ..... 126/247
4,480,592 11/1984 Gokcen ..... 122/26
4,733,635 3/1988 Menard et al. ..... 126/247
4,993,377 2/1991 Itakura ..... 123/142.1
5,199,539 4/1993 Kikuchi ..... 192/60
5,573,184 11/1996 Martin ..... 122/26
5,711,262 1/1998 Ban et al. ..... 126/247

FOREIGN PATENT DOCUMENTS 62-5048 1/1987 Japan ..... 126/247

*Primary Examiner*—Erick R. Solis
*Attorney, Agent, or Firm*—Brooks Haidt Haffner & Delahunty

[57] ABSTRACT

An improved viscous fluid heater is disclosed. The heater has a rotor that is operably coupled to a drive shaft. The rotor is disposed in a heating chamber filled with viscous fluid. The rotor is rotated with the drive shaft to shear the viscous fluid and generate heat in the heating chamber. The rotor has a flat rotor body and a boss. The boss has an axial length greater than that of the rotor body. A mechanism is provided with at least the boss. The mechanism mounts the rotor on the drive shaft and transmits torque of the drive shaft to the rotor.

19 Claims, 4 Drawing Sheets

VISCOUS FLUID HEATER

BACKGROUND OF THE INVENTION

1. Field of the Invention

The present invention relates to viscous fluid heaters, and more particularly, to structures for coupling drive shafts and rotors to one another in viscous fluid heaters.

2. Description of the Related Art

Viscous fluid heaters employed in automobiles are typically arranged adjacent to water jackets and provided with heating chambers. In the heating chamber, viscous fluid is agitated by a rotor to produce heat. Heat exchange takes place between the heat and the engine coolant in the water jacket. This heats the coolant and warms the passenger compartment.

U.S. Pat. No. 4,993,377 describes a typical viscous fluid heater. The heater includes a housing. A heating chamber and a water jacket, which is adjacent to the heating chamber, are defined in the housing. A rotor is arranged in the heating chamber. Labyrinth grooves are defined in the outer surface of the rotor and the walls of the heating chamber. The labyrinth grooves enable efficient heating of the heating chamber. When the rotor is rotated by the engine, the rotor shears the viscous fluid in the labyrinth grooves and heats the fluid. Heat exchange takes place between the heated viscous fluid and the coolant circulating in the water jacket. This heats the coolant and warms the passenger compartment as the coolant flows into a heater circuit.

In such a viscous fluid heater, the rotor includes a rotor body and a boss, which joins the rotor body to a drive shaft. The rotor body and the boss are formed integrally with each other. The axial length of the boss and the thickness of the rotor are substantially equal to each other. Thus, a larger rotor increases the size of the housing. This, in turn, enlarges the dimensions of the entire heat generator. As a result, it becomes difficult to provide enough space for the heat generator in an engine room.

Furthermore, the labyrinth grooves defined in the rotor and the wall of the heating chamber are required to be concentric with the axis of the drive shaft. Thus, the rotor, the heating chamber, and the drive shaft must be aligned with one another. Accordingly, the rotor and the heating chamber must be formed with high precision. Hence, manufacturing of such viscous fluid heaters is burdensome, and production costs are high.

SUMMARY OF THE INVENTION

Accordingly, it is an objective of the present invention to provide a smaller viscous fluid heater. More particularly, it is an objective of the present invention to provide a smaller viscous fluid heater without decreasing the durability of the structure for coupling the rotor.

It is another objective of the present invention to provide a viscous fluid heater that is easily manufactured and thus saves manufacturing costs.

To achieve the above objectives, the present invention provides a heater having a rotor operably coupled to a drive shaft and located in a heating chamber accommodating viscous fluid. The rotor is arranged to be rotated with the drive shaft to shear the viscous fluid and generate heat in the heating chamber. The rotor has a flat rotor body and a boss. The boss has an axial length greater than that of the rotor body. The heater further includes a structure for mounting the rotor on the drive shaft. The mounting structure is provided with at least the boss and transmits torque of the drive shaft to the rotor.

Other aspects and advantages of the invention will become apparent from the following description, taken in conjunction with the accompanying drawings, illustrating by way of example the principals of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a viscous fluid heater according to the present invention that is incorporated in a heating apparatus of an automobile will now be described with reference to FIGS. 1 to 2.

Figure 1:
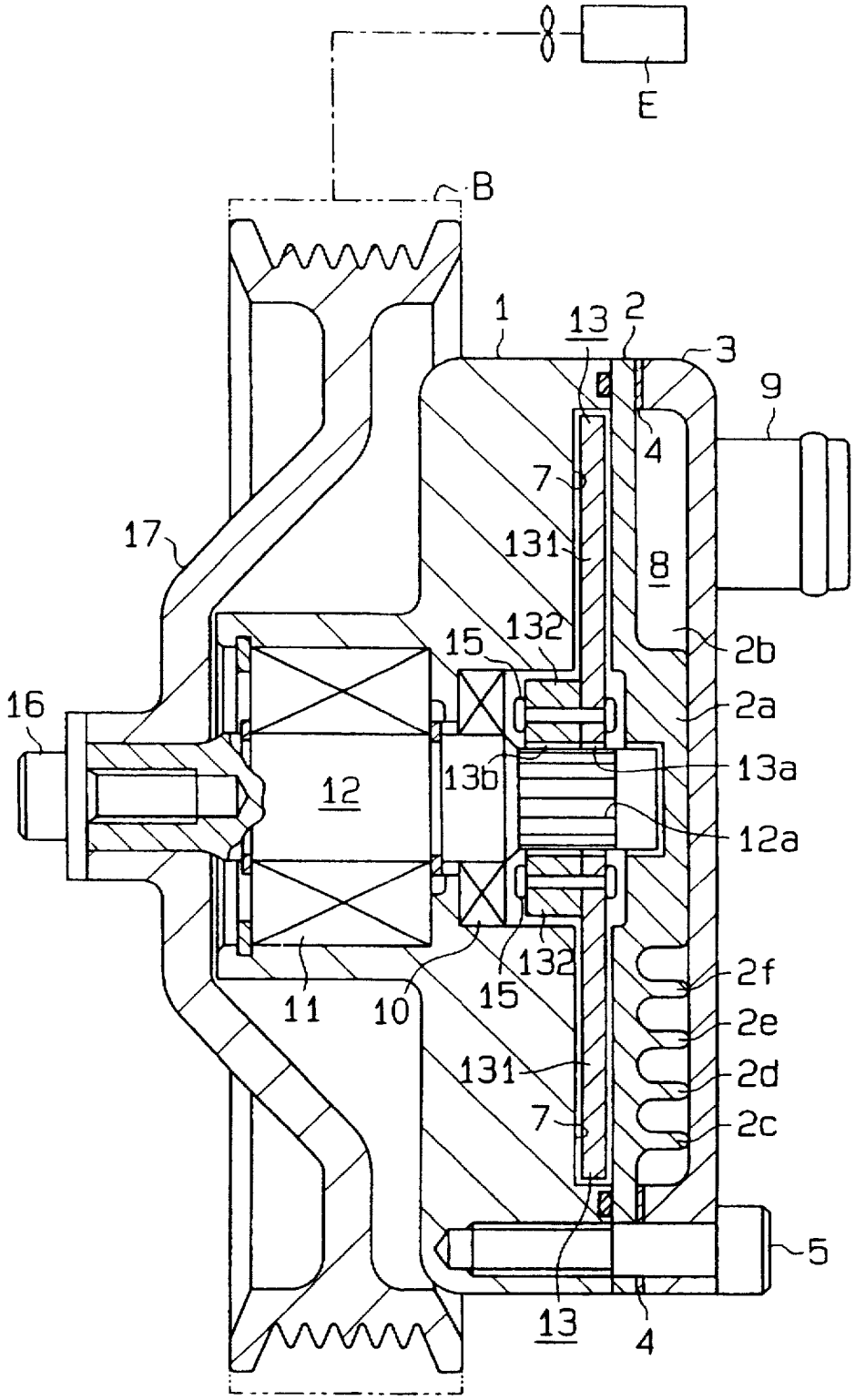
FIG. 1 is a cross-sectional drawing showing a first embodiment of a viscous fluid heater according to the present invention.
Figure 2:
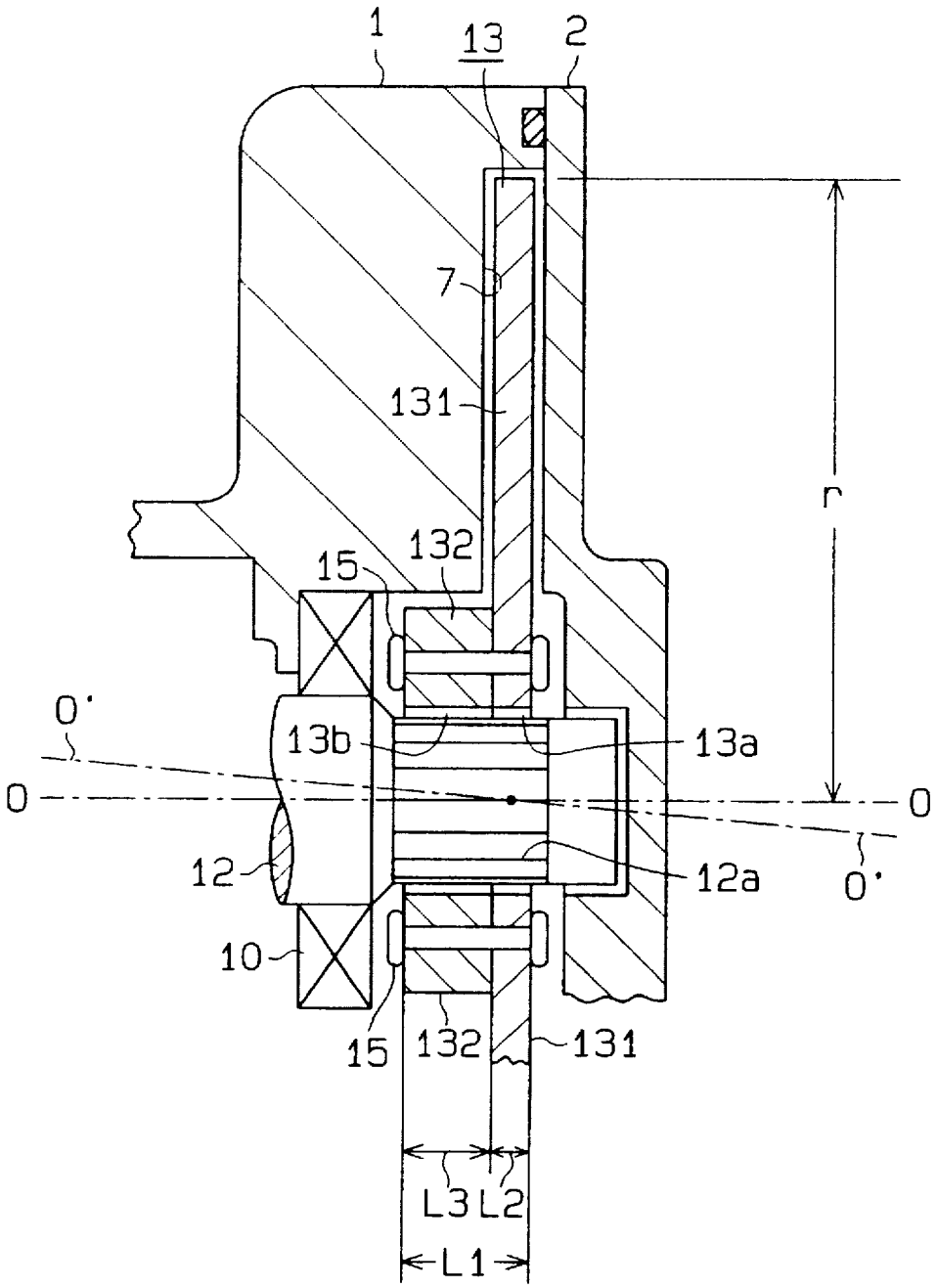
FIG. 2 is an enlarged cross-sectional drawing showing a portion of FIG. 1.

As shown in FIG. 1, a plurality of bolts 5 (only one shown) fasten a front housing 1 and a rear housing 3 to each other with a partitioning plate 2 and a gasket 4 arranged in between. A recess is provided in the rear surface of the front housing 1. A heating chamber 7 is defined between the recess and the flat front surface of the plate 2. A water jacket 8 is defined adjacent to the heating chamber 7 between the rear surface of the plate 2 and the inner wall of the rear housing 3. An inlet port 9 and an outlet port (not shown) are provided in the rear housing 3. Coolant circulating through a heater circuit of the automobile is drawn into the water jacket 8 through the inlet port 9 and discharged from the water jacket 8 through the outlet port.

A projection **2*a* and a partition 2*b* are provided at the rear side of the plate 2. The projection 2*a* is located at the center of the plate 2 while the partition 2*b* extends radially from the projection 2*a* toward the middle of the inlet port 9 and the outlet port. A plurality of fins 2*c*, 2*d*, 2*e*, 2*f* are further provided at the rear side of the plate 2 extending in an arc-like manner about the projection 2*a* from the vicinity of the inlet port 9 to the vicinity of the outlet port. The end of the projection 2*a*, the partition 2*b*, and the fins 2*c*–2*f* abut against the inner wall of the rear housing 3 and define a passage for circulation of the coolant through the water jacket 8 between the inlet port 9** and the outlet port.

A seal 10 and a bearing 11 are provided adjacent to the heating chamber 7. A drive shaft 12 is rotatably supported by the seal 10 and the bearing 11. Splines **12*a* extending axially and parallel to one another are provided on the rear end of the drive shaft 12. A rotor 13, which is accommodated in the heating chamber 7, is fitted to the drive shaft 12. The heating chamber 7** is filled with silicone oil, which serves as the viscous fluid.

The rotor 13 includes a disk-like rotor body 131 and a boss 132 fastened to the rotor body 131. A hub bore extends through the center of the rotor body 131 and of the boss 132. Splines 13*a* and 13*b* corresponding to the splines 12*a* are provided on the wall of the hub bore. The splines 13*a* cooperatively engage with the splines 12*a* to prohibit relative rotation and to permit axial (thrust direction) displacement of the rotor body 131 with respect to the drive shaft 12. A certain clearance is provided between the splines 12*a* and the splines 13*a*, 13*b* to allow tilting of the rotor body 131 and the boss 132 with respect to the axis of the drive shaft 12.

The boss 132 and the rotor 131 are independent parts. In addition, the axial (thrust direction of the drive shaft 12) length of the boss 132 is greater than the axial length (thickness) of the rotor body 131. It is preferable that the boss 132 be made of a hard material. This is not required of the rotor body 131. Since the rotor body 131 is independent from the boss 132, the rotor body 131 may be made of a material that is softer and easily machined. The boss 132, which requires a high level of hardness, should be made of a material that is harder and more expensive than the material of the rotor body 131. The rotor body 131 is ground before coupling the boss 132 to the body 131. Therefore, in comparison with the prior art, the grinding of the front and rear faces of the rotor body 131 is facilitated since the faces are flat and unobstructed. The drive shaft 12 and the boss 132 are also independent from each other. Since the drive shaft 12 and the boss 132 are machined from the same hard material in the prior art, the structure of the present invention facilitates mass production and reduces part costs.

A plurality of rivets 15 fastens the rotor body 131 to the boss 132. Thus, the rotor body 131 and the boss 132 are effectively integral with each other. This structure restricts rotation of the rotor body 131 and the boss 132 with respect to the drive shaft 12 while allowing axial displacement therebetween.

As shown in FIG. 1, a pulley 17 is fastened to the front end of the drive shaft 12 by a bolt 16. A belt B connects the pulley 17 to an engine E of the automobile. Thus, the drive force of the engine E is transmitted by the belt B to rotate the drive shaft 12. The spline joint rotates the rotor body 131 and the boss 132 integrally with the drive shaft 12. The rotation produces a shearing effect acting on the silicone oil in the space between the inner wall of the heating chamber 7 and the outer surface of the rotor 13 and produces heat. Heat exchange takes place between the heated silicone oil and the coolant circulating through the water jacket 8. The heated coolant flows into the heater circuit (not shown) and warms the passenger compartment.

The contact stress $\sigma$[kgf/mm$^2$] that acts on the engaged surface of the spline joint is expressed by the equation described below.

$$\sigma=M/\psi LRA$$

In the equation, M[kgf·mm] represents the transmission torque applied to the joint, L[mm] represents the contact length of the splines, R[mm] represents the arm length of the transmission torque, A[mm$^2$/mm] represents the total pressurized area of the splines per millimeter of spline contact length, and $\psi$ represents the compensation coefficient related to the contact level between the spline hub and the spline shaft. If the inner diameter of the spline hub is represented by Dk[mm] while the outer diameter of the spline shaft is represented by D2, the arm length R[mm] of the transmission torque is expressed by the equation described below.

$$R=(Dk+D2)/4$$

In this embodiment, the rotor body 131 and the boss 132 are coupled with the drive shaft 12 through the spline joint. The spline joint also integrally couples the rotor body 131 and the boss 132. In other words, the spline joint joins the single mass of the rotor body 131 and the boss 132 to the drive shaft 12. As a result, the spline contact length L1 is equal to the sum of the thickness L2 of the rotor body 131 and the axial length L3 of the boss 132 (L1=L2+L3). If the boss 132 is not employed, the spline contact length is equal to L2. However, the employment of the boss 132 enables the spline contact length to increase by the length L3. The axial length of the boss 132 is preferably at least twice the thickness of the rotor 131.

The employment of the boss 132 increases the length of the spline joint and decreases the contact stress $\sigma$ of the contacted surface per unit area in the spline joint. This prolongs the life of the spline joint portion and improves the durability of the viscous fluid heater.

The boss is not limited to a cylindrical boss or hub as long as it is provided on the drive shaft at the center of the rotor to reinforce the structure coupling the drive shaft to the rotor.

As apparent from the contact stress equation, the contact stress $\sigma$ is inversely proportional to the spline contact length L. Therefore, the elongations of the splines in the present invention dramatically reduces the contact stress $\sigma$ acting between the spline 12*a* and the splines 13*a*, 13*b*.

Since the boss 132 increases the spline contact length L1 between the rotor 13 and the drive shaft 12, the thickness L of the rotor body 131 may be minimized. This allows production of a more compact viscous fluid heater.

The heating rate H1 of the viscous fluid in the front and rear sides of the rotor 13 and the heating rate H2 of the viscous fluid at the peripheral portion of the rotor 13 is obtained from the equation described below.

$$H_1=\Pi\mu\omega^2 r^4/D$$

$$H_2=2\Pi\mu\omega^2 r^3 L_2/D$$

In these equations, $\mu$ represents the viscosity coefficient, r represents the radius of the rotor, D represents the distance between the wall of the heating chamber 7 and the outer surface of the rotor 13, and $\omega$ represents the angular velocity of the rotor 13 when rotated. When the condition of $2L_2<r$ is obtained, the condition of $H_2<H_1$ is satisfied. This results in a great heating value at the front and rear sides of the rotor 13. Thus, heat exchange takes place effectively between the viscous fluid heater and the coolant circulating through the water jacket 8, which is arranged in the vicinity of the rear side of the rotor 13. Accordingly, the superior heat transfer effects of the prior art viscous fluid heaters having labyrinth grooves in the heating chamber 7 are also achieved through the present invention.

In this type of viscous fluid heater, the force produced by the tension applied to the belt B engaging the pulley 17 acts in a radial direction to the axis of the drive shaft 12. The radial force tends to displace the optimal axis O to the inclined axis O', as shown in FIG. 2. Furthermore, the dimensional margins that result from production may cause the dimension of the space defined between the rotor body 131 and the inner wall of the heating chamber 7 to be out of conformity. These factors may cause the ends of the drive shaft 12 to orbit. This, in turn, may lead to contact between the rotor body 131 and the inner wall of the heating chamber 7.

However, in the viscous fluid heater according to the present invention, the rotor body 131 and the boss 132 are joined to the drive shaft 12 by splines. This enables inclination and axial displacement of the rotor body 131 and the boss 132 with respect to the drive shaft 12. Such structure offsets the undesirable inclination of the drive shaft 12. In other words, if a radial belt force causes the drive shaft 12 to rotate about the axis O', the resistance produced by the viscous fluid and the inclination and axial displacement of the rotor body 131 and the boss 132 compensates for the inclination of the drive shaft 12. Also, if the rotor body 131 contacts the inner surface of the heating chamber 7, the rotor body 131 and the boss 132 are displaced axially. This decreases contact pressure and prevents damage of the rotor body 131 and other parts. Accordingly, the space between tile outer surface of the rotor body 131 and the inner wall of the heating chamber 7 may be minimized while avoiding interference therebetween. This contributes to efficient heating.

Figure 3:
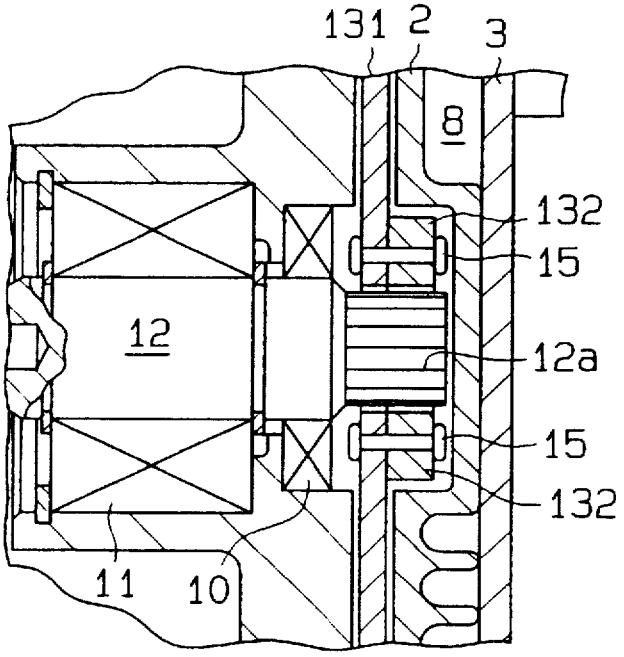
FIG. 3 is a cross-sectional drawing showing a further embodiment of a viscous fluid heater according to the present invention.

A further embodiment according to the present invention is shown in FIG. 3. In this embodiment, the boss 132 is arranged at the rear side of the rotor body 131. The advantageous effects of the first embodiment are also obtained through this embodiment.

Furthermore, the spline joint may be provided only between the drive shaft 12 and the boss 132. In this case, space may be provided between the wall of the hub bore in the rotor body 131 and the outer surface of the drive shaft 12.

Figure 4:
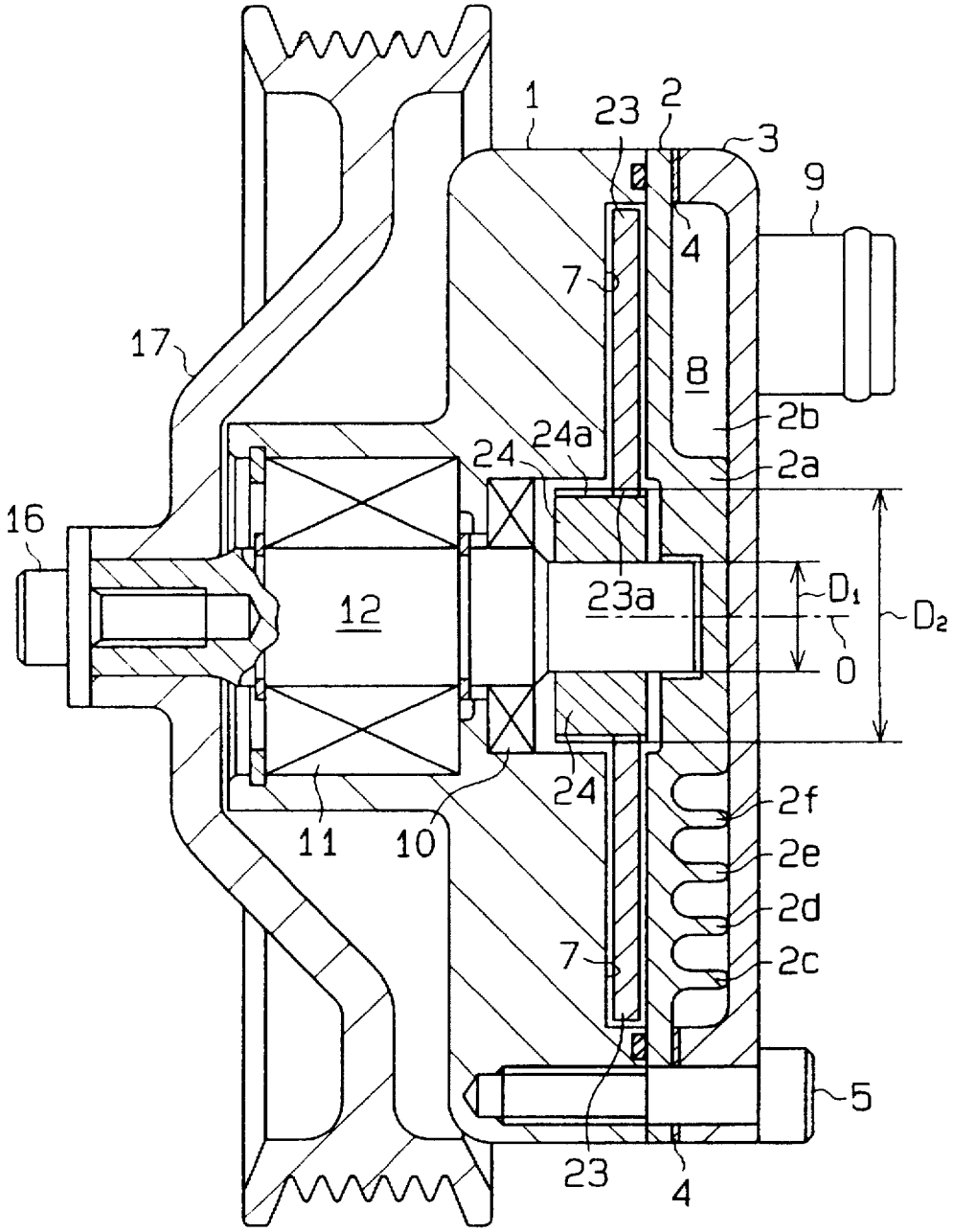
FIG. 4 is a cross-sectional drawing showing another embodiment of a viscous fluid heater according to the present invention.

A further embodiment of a viscous fluid heater according to the present invention is shown in FIG. 4. To avoid a redundant description, like or same numerals are given to those components that are like or the same as the corresponding components of the first embodiment.

The boss 24 is fixed to the drive shaft 12 without providing splines at the rear end of the drive shaft 12. A disk-like rotor body 23 accommodated in the heating chamber 7 is attached to the boss 24. Splines 24*a* extend axially along the periphery of the boss 24. A hub bore extends through the center of the rotor body 23. Splines 23*a* corresponding to the splines 24*a* are provided in the wall of the hub bore. The engagement between the splines 24*a* and the splines 23*a* restricts rotation of the rotor body 23 with respect to the drive shaft 12 and the boss 24. The engagement also allows inclination and displacement of the drive shaft 12 with respect to the axes of the drive shaft 12 and the boss 24.

The equation used to obtain the contact stress $\sigma$ acting at the contacted side of the spline ($\sigma=M/\psi LRA$) in the first embodiment may also be applied to this embodiment. In this equation, the arm length of the transmission torque $R=(Dk+D2)/4$ corresponds to the distance from the axis O of the drive shaft 12 to the engaged portion between the splines 24*a* and the splines 23*a*.

Dk corresponds to the inner diameter of the hub bore in the rotor body 23 and D2 represents the outer diameter of the boss 24. If Dk and D2 are set at relatively large values, D2 and Dk may be approximated as being substantially equal to each other. In this case, the equation described below is satisfied.

$$R=(Dk+D2)/4=D2/2$$

Accordingly, the arm length R of the transmission torque may be approximated as being equal to the radius of the boss 24.

It is apparent from the equation used to obtain the contact stress $\sigma$ that the contact stress a is inversely proportional to the arm length R of the transmission torque. Hence, the contact stress $\sigma$ acting at the contact potion of the spline is inversely proportional to the radius of the boss 24. As apparent from FIG. 4, the diameter D2 of the boss 24 is greater than the diameter D1 of the drive shaft 12 ($D1<D2$). If the boss 24 is not employed, the arm length R of the transmission torque is approximately the same as the radius of the drive shaft 12 (D1/2). Therefore, the contact stress $\sigma$ is reduced when the boss 24 is employed.

Therefore, the contact stress $\sigma$ per unit area of the engaged surface of the spline joint is reduced by providing the boss 24 between the drive shaft 12 and the rotor body 23 to increase the arm length R of the transmission torque.

The advantageous effects of the first embodiment are also obtained through this embodiment. In this embodiment, the boss 24 is press fitted onto the drive shaft 12 without using rivets or other fasteners. This reduces the number of necessary components and simplifies the structure of the viscous fluid heater.

In this embodiment, the drive shaft 12 and the boss 24 may be formed integrally.

In the present invention, an electromagnetic clutch may be provided between the pulley 17 and the drive shaft 12 to intermittently transmit the drive force of the engine E to the drive shaft 12 of the viscous fluid heater.

Although several embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A heater comprising a drive shaft, a heating chamber for accommodating viscous fluid, a rotor operably coupled to the drive shaft and located in the heating chamber, said rotor being arranged to be rotated with the drive shaft to shear the viscous fluid and generate heat in the heating chamber, said rotor including a flat rotor body and a boss defining an opening therethrough, said drive shaft being received within said opening, said boss having an axial length greater than that of the rotor body; and means for mounting the rotor on the drive shaft for transmitting torque of the drive shaft to the rotor, said mounting means including at least said boss.

2. The heater as set forth in claim 1, wherein said boss is separately formed from the rotor body.

3. The heater as set forth in claim 2 further comprising means for securing the boss to the rotor body.

4. The heater as set forth in claim 1, wherein said mounting means rotates the rotor integrally with the drive shaft and is axially movable with respect to the drive shaft.

5. The heater as set forth in claim 4, wherein said rotor has a radius at least twice the axial length of the rotor body.

6. The heater as set forth in claim 5, wherein said opening of said boss is a central hole having an inner peripheral surface including a first element, said drive shaft has an outer peripheral surface including a second element, and said mounting means comprises a spline joint formed by said first element and said second element.

7. The heater as set forth in claim 6, wherein said boss is attached to at least one of a front surface and a rear surface of the rotor body.

8. The heater as set forth in claim 3, wherein said securing means includes a rivet.

9. The heater as set forth in claim 1, wherein said rotor body has a central hole having an inner peripheral surface including a first element, said boss is fixed to the drive shaft and has an outer periphery having a second element, and said mounting means comprises a spline joint formed by said first element and said second element.

10. A heater comprising a drive shaft, a heating chamber for accommodating viscous fluid, a rotor operably coupled to the drive shaft that is driven by torque of a vehicle engine, said rotor being disposed in the heating chamber, said rotor being arranged to be rotated with the drive shaft to shear the viscous fluid and generate heat in the heating chamber, said rotor including a flat rotor body and a boss separately formed from the rotor body, said boss having an axial length greater than that of the rotor body, said rotor having a radius at least twice the axial length of the rotor body, and said heater further comprising means for mounting the rotor on the drive shaft for transmitting torque of the drive shaft to the rotor, said mounting means including at least said boss.

11. The heater as set forth in claim 10, further comprising means for securing the boss to the rotor body.

12. The heater as set forth in claim 11, wherein said boss has a central hole having an inner peripheral surface including a first element, said drive shaft has an outer peripheral surface including a second element, and said mounting means comprises a spline joint formed by said first element and said second element.

13. The heater as set forth in claim 11, wherein said boss is attached to at least one of a front surface and a rear surface of the rotor body.

14. The heater as set forth in claim 13, wherein said securing means includes a rivet.

15. The heater as set forth in claim 14, further comprising:

a pulley connected to an end of the drive shaft; and a belt for operably coupling the pulley to the engine.

16. The heater as set forth in claim 10, wherein said rotor body has a central hole having an inner peripheral surface including a first element, said boss is fixed to the drive shaft and has an outer periphery having a second element, and said mounting means comprises a spline joint formed by said first element and said second element.

17. The heater as set forth in claim 16, further comprising:

a pulley connected to an end of the drive shaft; and a belt for operably coupling the pulley to the engine.

18. A heater comprising;

a drive shaft;

a heating chamber for accommodating viscous fluid;

a rotor including a flat rotor body, said rotor being operably coupled to said drive shaft and located in said heating chamber such that when said rotor is rotated by said drive shaft, the viscous fluid is sheared by said rotor body, generating heat in said heating chamber;

a boss having an axial length greater than that of said rotor body, said boss defining a central opening therethrough, said central opening having an inner peripheral surface including a first element, said boss being connected to said rotor body;

said drive shaft having an outer peripheral surface including a second element; and said first element and said second element forming a spline joint mounting said boss and said rotor on said drive shaft.

19. The heater as set forth in claim 18, wherein said rotor has a central opening having an inner peripheral surface including a third element, said third element of said rotor and said second element of said drive shaft forming a spline joint further mounting said rotor on said drive shaft.

* * * * *

UNITED STATES PATENT AND TRADEMARK OFFICE

CERTIFICATE OF CORRECTION

PATENT NO. : 5,799,619

DATED : September 1, 1998

INVENTOR(S) : T. Hoshino et al.

In the Claims:

Column 5, line 11, change "tile" to –the".

line 61, after 'stress" (second occurrence), delete "a" and insert — σ —.

Signed and Sealed this

Twenty-third Day of February, 1999

*Attest:*

Q. TODD DICKINSON

*Attesting Officer*

*Acting Commissioner of Patents and Trademarks*